US007673703B2

(12) United States Patent
Fischer et al.

(10) Patent No.: US 7,673,703 B2
(45) Date of Patent: Mar. 9, 2010

(54) HAND-HELD POWER TOOL HAVING MAIN AND HANDLE HOUSINGS WITH A CONNECTION DEVICE FOR CONNECTING THE HOUSINGS

(75) Inventors: Axel Fischer, Wiedergeltingen (DE); Ernst-Rudolf Luebkert, Landsberg (DE); Pierre Pallmer, JgLing (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/502,110

(22) Filed: Aug. 10, 2006

(65) Prior Publication Data

US 2007/0044984 A1 Mar. 1, 2007

(30) Foreign Application Priority Data

Aug. 11, 2005 (DE) ..... 10 2005 038 088

(51) Int. Cl.
*E21B 4/12* (2006.01)

(52) U.S. Cl. ..... 173/217; 173/216; 173/201; 173/210

(58) Field of Classification Search ..... 173/162.1, 173/162.2, 201, 210, 217; 29/525; 267/137, 267/139, 140, 141; 30/381
See application file for complete search history.

(56) References Cited

U.S. PATENT DOCUMENTS 4,749,049 A * 6/1988 Greppmair ..... 173/162.2
4,800,965 A * 1/1989 Keller ..... 173/162.2
5,692,574 A * 12/1997 Terada ..... 173/162.2
6,076,616 A * 6/2000 Kramp et al. ..... 173/162.2
6,907,942 B2 * 6/2005 Kikuchi et al. ..... 173/114

FOREIGN PATENT DOCUMENTS

| | | | |
|---|---|---|---|
| AU | 2004231220 | A1 | 6/2005 |
| DE | 10036078 | A1 | 2/2002 |
| EP | 1533084 | A1 | 5/2005 |
| GB | 610525 | A | 10/1948 |

OTHER PUBLICATIONS

European Search Report in EP06118197, dated Nov. 17, 2006, corresponding to the present application.

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

A hand-held power tool having a main housing (4) in which a tool spindle (10) is at least partially located, and a handle housing (16) on which a handle (18) is formed, includes a connection device (28) for securing the handle housing (16) to the main housing (16) and having a first connection element (50) with a first engagement member (58) loosely engageable with a second engagement member (52) associated with the main housing (4), and a second connection element (48) with a handle-side locking element, a main housing side locking element, and a further locking element for formlockingly connecting the handle-side locking element and the main housing side locking element, whereby absence of loose engagement of the first and second engagement members is ensured upon formation of the formlocking connection of the handle-side and main housing side locking elements.

4 Claims, 5 Drawing Sheets

HAND-HELD POWER TOOL HAVING MAIN AND HANDLE HOUSINGS WITH A CONNECTION DEVICE FOR CONNECTING THE HOUSINGS

BACKGROUND OF THE INVENTION

1. Field of the Invention

The present invention relates to a hand-held power tool, in particular to an electrical hammer drill, a chisel or rotary-percussion power tool, a motorized saw such as a fret or saber saw, a cutting tool, or a grinding power tool such as a angle grinding tool. The hand-held power tool includes a main housing and a tool spindle at least partially located in the housing and extending along an operational axis. The tool spindle carries a chuck. The power tool further includes a handle housing on which a handle is formed and a connection device for securing the handle housing to a rear side of the main housing remote from the chuck. The connection device has two connection elements spaced from each other in a direction perpendicular to the operational axis of the power tool.

2. Description of the Prior Art

Hand-held tools of the type described about enable, by forming the handle housing separately from the main housing, a preliminary assembly, in particular, of electric or electronic components in the handle. The handle can, thus, be formed separately form remaining part of the hand-held power tool, e.g., in a spacially separated operation, with all of mounted therein components, and only then be assembled with the remaining part of the power tool during a final assembly. In addition, in such hand-held power tools, between the handle housing or the handle and the main housing, there can be provided means that prevents transmission of vibrations, which occur during operation, by isolation of the vibrations or their damping, from the main housing to the handle.

German Publication DE 100 36 078 A1 discloses a hand-held power tool having a handle that is connected at one of its ends to a housing with pivot connection means. At its other end, the handle is connected with the housing by an isolating device. The isolating device has a spring for isolating the vibrations. The spring is supported between the handle and an adjusting gear which itself is secured on the housing by a retaining screw with a possibility of adjustment in the axial direction. Parallel to the retaining screw, between the handle and the housing, there are provided two guide bolts which guide the handle about the pivot connection means during a pivotal movement which is being damped by the spring. In the known hand-held power tool, the preloading of the spring can be adapted, by using the adjusting gear, to different applications to be able to insure the isolation of the handle from vibrations at each application.

However, the drawback of the known hand-held power tool consists in that both the pivot connection means and the isolating device that forms another connection means, which connect the handle to the housing, have a large number of separate elements, which makes the attachment of the handle to the housing more difficult and increases manufacturing costs. A further drawback of the known power tool consists in that the vibrations that act in a direction transverse to the operational direction, are transmitted undiminished. Thereby, the handle is subjected to vibrations that can be transmitted to the tool user despite isolation of the vibrations in the operational direction, as discussed above.

Accordingly, an object of the present invention is a hand-held power tool in which the above-mentioned drawbacks are eliminated.

Another object of the present invention is a hand-held power tool that can be produced with reduced manufacturing costs.

SUMMARY OF THE INVENTION

These and other objects of the present invention, which will become apparent hereinafter, are achieved by providing a connection device for securing the handle housing to the main housing in which the first connection means includes a first engagement member associated with the handle housing and loosely engageable with a second engagement member associated with the main housing. Under a loose engagement, such engagement is understood at which the first and second engagement members are not held directly over each other at least in one direction. The second connection means of the connection device includes handle side locking means, main housing side locking means, and further locking means for formlockingly connecting the handle-side locking means and the main housing side locking means. The connection device according to the present invention insures upon formation of a formlocking connection of the handle-side locking means with the main housing side locking means, simultaneously, absence of loose engagement in the first connection means. I.e., the first and second engagement members are not separable from each other along the at least one direction, in which they were not held directly over each other. Thereby, the engagement along other directions is maintained. With the inventive connection device, the connection of the handle housing with the main housing requires less separate elements, which simplifies the assembly and reduces manufacturing costs. In addition, the inventive connection device insures a stable connection of the handle housing with the main housing.

Advantageously, the handle-side locking means has at least one handle-side opening and the main housing side locking means has at least one main housing side opening, and the further locking means brings the handle-side and main housing side openings into engagement with each other. Thereby, the second connection means can be formed with few, easily formed elements which provide for a stable connection. The openings can, e.g., be formed as threaded openings for forming a screw connection, as engagement profiles for forming a further formlocking engagement, or be formed as bores that can be aligned with each other for forming a simple locking connection by using the further locking means.

According to a particular advantageous embodiment of the present invention, the further locking means is formed by a third housing part securable to at least one of the first and second housing parts, which are formed by the main housing and the handle housing, respectively. The further locking means is formed by a housing part that carries an additional function. Thereby, the number of the to-be-assembled separate elements of a hand-held power tool is further reduced.

Advantageously, the further locking means is formed as a motor cover which is screwed to the main housing. Thereby, a particular stable formlocking connection of both locking means can be insured.

Preferably, the further locking means comprises a pin-shaped projection and the handle-side and main housing side openings are brought in alignment with each other. The projection is extendable through both openings. Thereby, the formlocking connection between the handle housing and the main housing are formed by an easily produced and mountable constructions.

Advantageously, at least one elastic element is provided between the further locking means and at least one of the handle-side locking means and the main housing side locking means.

With the elastic element, which further isolates and damps the vibration, there is provided a formlocking connection between the handle housing and the main housing that permits to achieve an increase reduction of vibrations transmittable to the handle housing.

It is further advantageous when the elastic element is circumferentially held on respective locking means and has an opening through which the at least one projection of the further locking means is extendable. Thereby, on one hand, in a simple manner, a formlocking connection between the handle-side and main housing side locking means can be formed, using the projection. On the other hand, simultaneously, a certain clearance between the projection and the handle-side locking means can be used for damping the vibrations or their isolation.

According to a particular advantageous embodiment of the present invention, the engagement member of the handle-side locking means has a concave profile fixedly connectable with one of the handle housing and the main housing, and the engagement member of the main housing side locking means has a convex profile fixedly connectable with another of the handle housing and the main housing. The concave and convex profiles, which are associated with a respective one of the handle and main housings enables a pivotal movement of both housings about the second connection means. Thereby, the locking means of the first connection means can be easily aligned, with a subsequent formlocking connection therebetween by the projections of the further locking means.

Advantageously, a further elastic element is arranged between the concave profile of the first engagement member and the convex profile of the second engagement member.

In this way, the connection, which is formed by the engagement members also provides for isolation or damping of vibrations between the handle and main housings. Thereby, the transmission of the vibrations to the handle is further reduced.

Advantageously, at least one of the elastic elements is formed of a foamed plastic material. In this way, even with a complex geometry of the elastic element(s) a cost-effective damping, which insures a noticeable reduction of vibrations, can be achieved.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
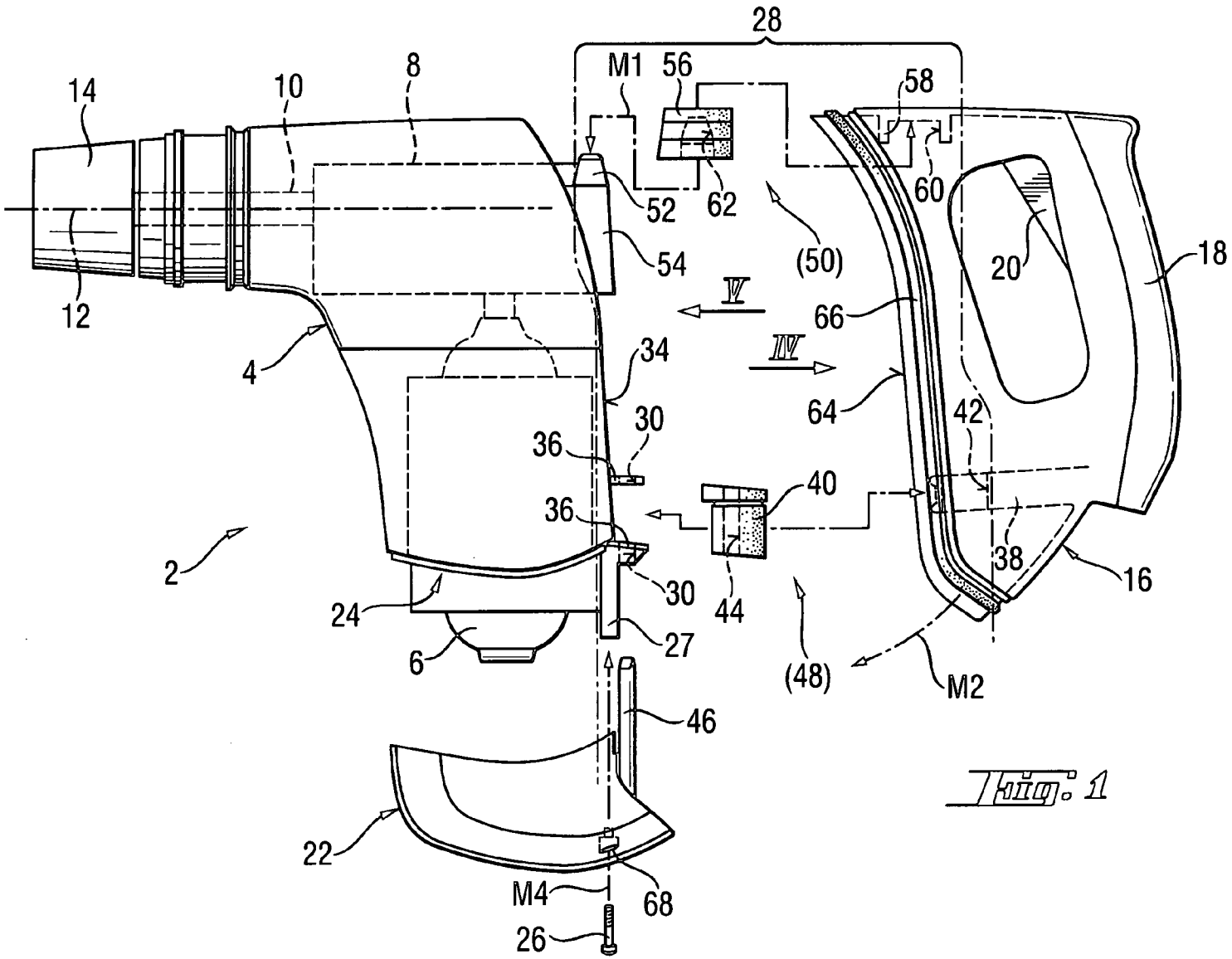
FIG. 1 an exploded side view of a hand-held power tool according to the present invention.

FIG. 1 shows a hand-held power tool 2 that is formed as a hammer drill and has essentially a three-part housing. The tool housing includes a main housing 4 in which a motor 6 and a drive gear 8, shown schematically, are located. The drive gear 8 drives a tool spindle 10 which extends along an operational axis 12 and with which a chuck 14 is connected for joint rotation therewith.

A second housing part is formed as a handle housing 16 on which a handle 18 is formed. The handle 18 permits to hold the power tool 2 with one hand. On the handle 18, there is provided a pushbutton 20 that can be actuated with the same hand that holds the power tool 2.

A motor cover 22, which is formed separately from the main housing 4, forms the third housing part and is designed for closing the opening 24 of the main housing 4 in the region of the motor 6. The motor cover 22 is secured on the housing 4 with screws 26 and an extension 27.

A connection device, which is generally designated with a reference numeral 28, connects the handle housing 16 with the main housing 4 and/or the motor cover 22.

The first connection means 50 has, on the main housing side, a convex engagement member 52 which is provided on or projects from a drive gear housing 54 and is engaged from behind by an engagement member 58 on the handle housing side, with a first elastic element 56 of a foamed plastics being provided therebetween.

Figure 2:
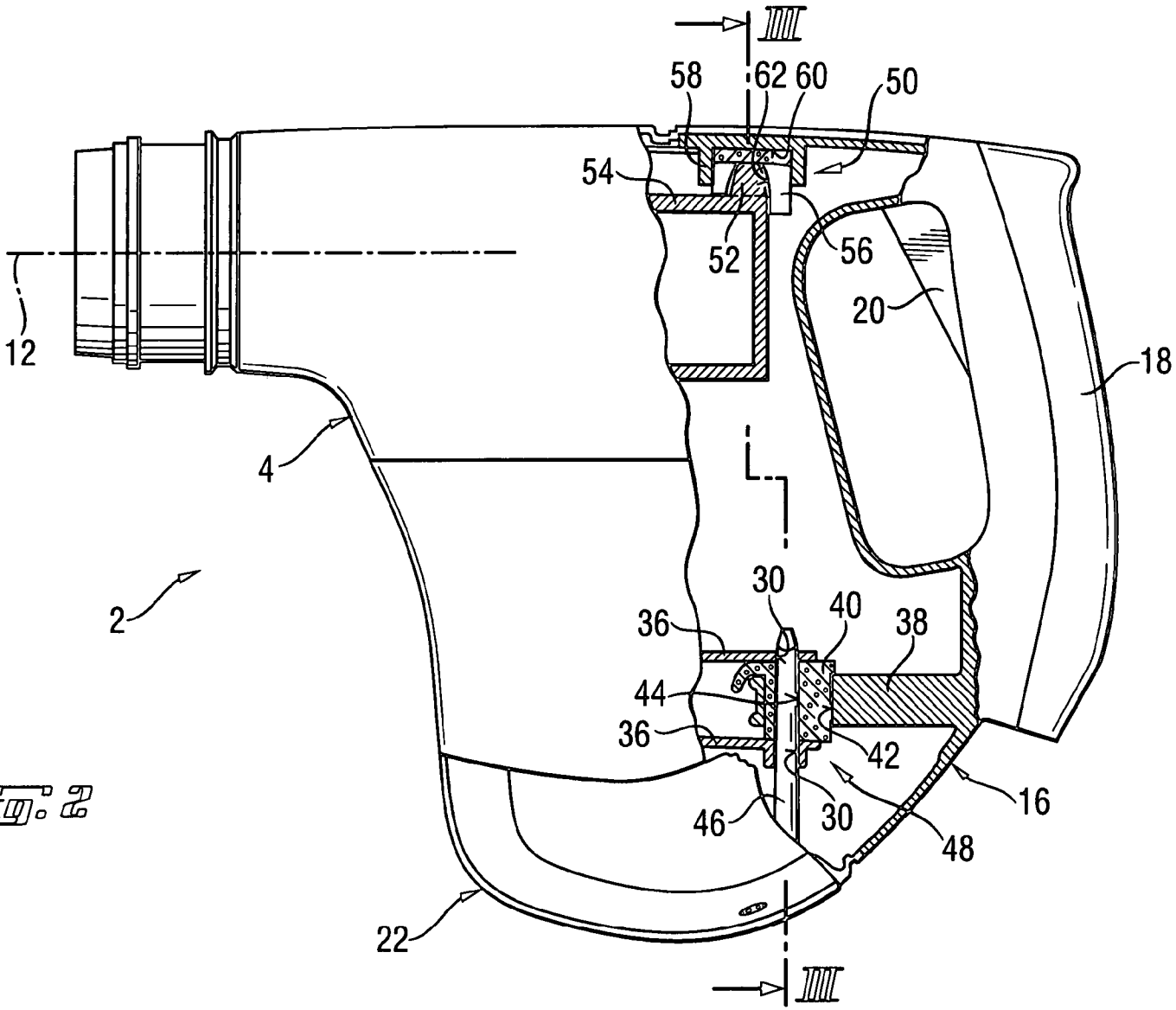
FIG. 2 a partially cross-sectional side view of the power tool according to FIG. 1.

The engagement member 58 has an essentially concave receptacle 60 which is formed on the handle housing 16 and in which the first elastic element 56 is received. The first elastic element 56 forms a receiving space 62 which is open from one side and in which the convex engagement member 52 can be received, as it is particularly shown in FIG. 2.

Figure 3:
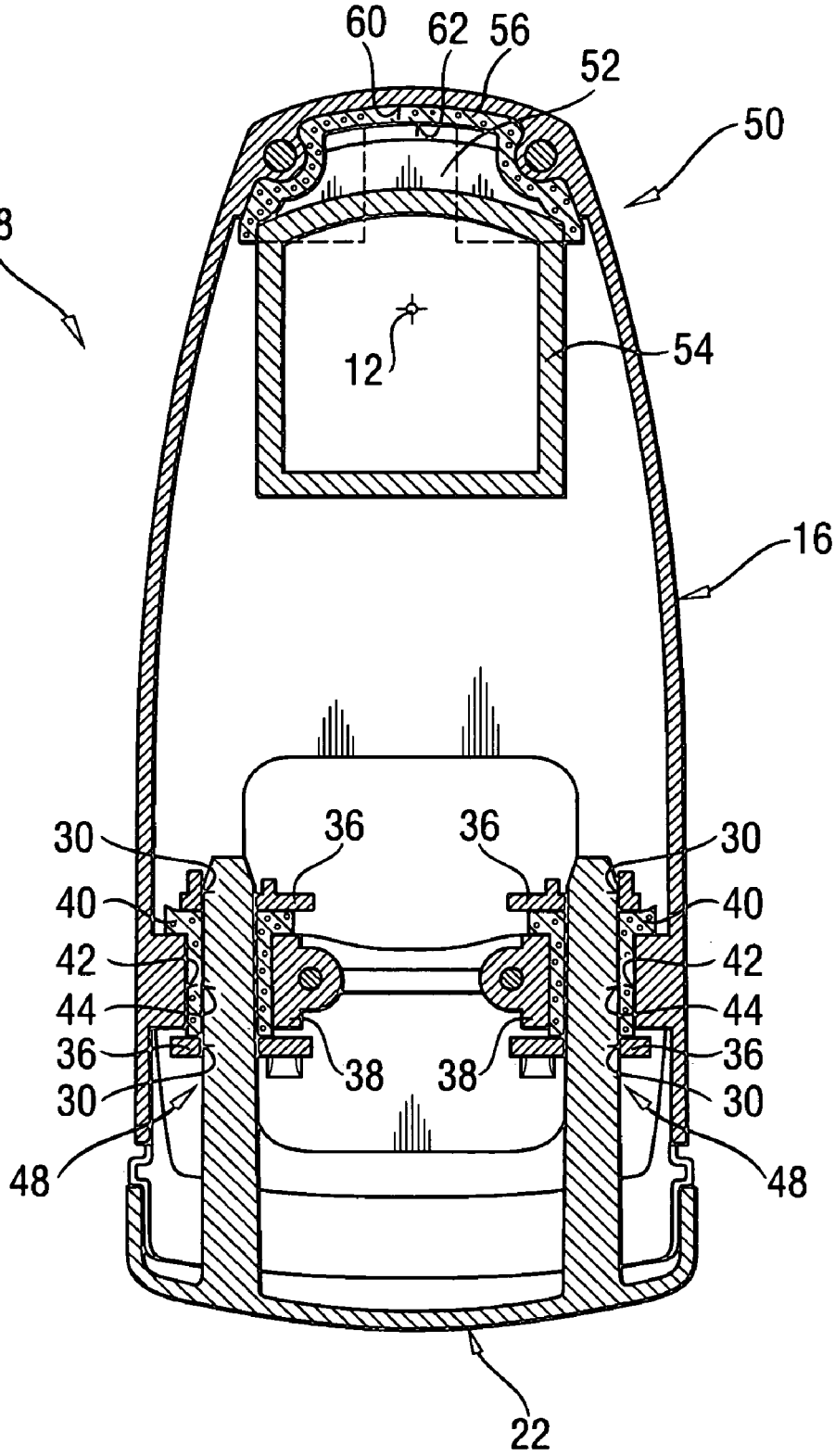
FIG. 3 a cross-sectional view of a connection device of the power tool according to FIG. 2 along line III-III.
Figure 4:
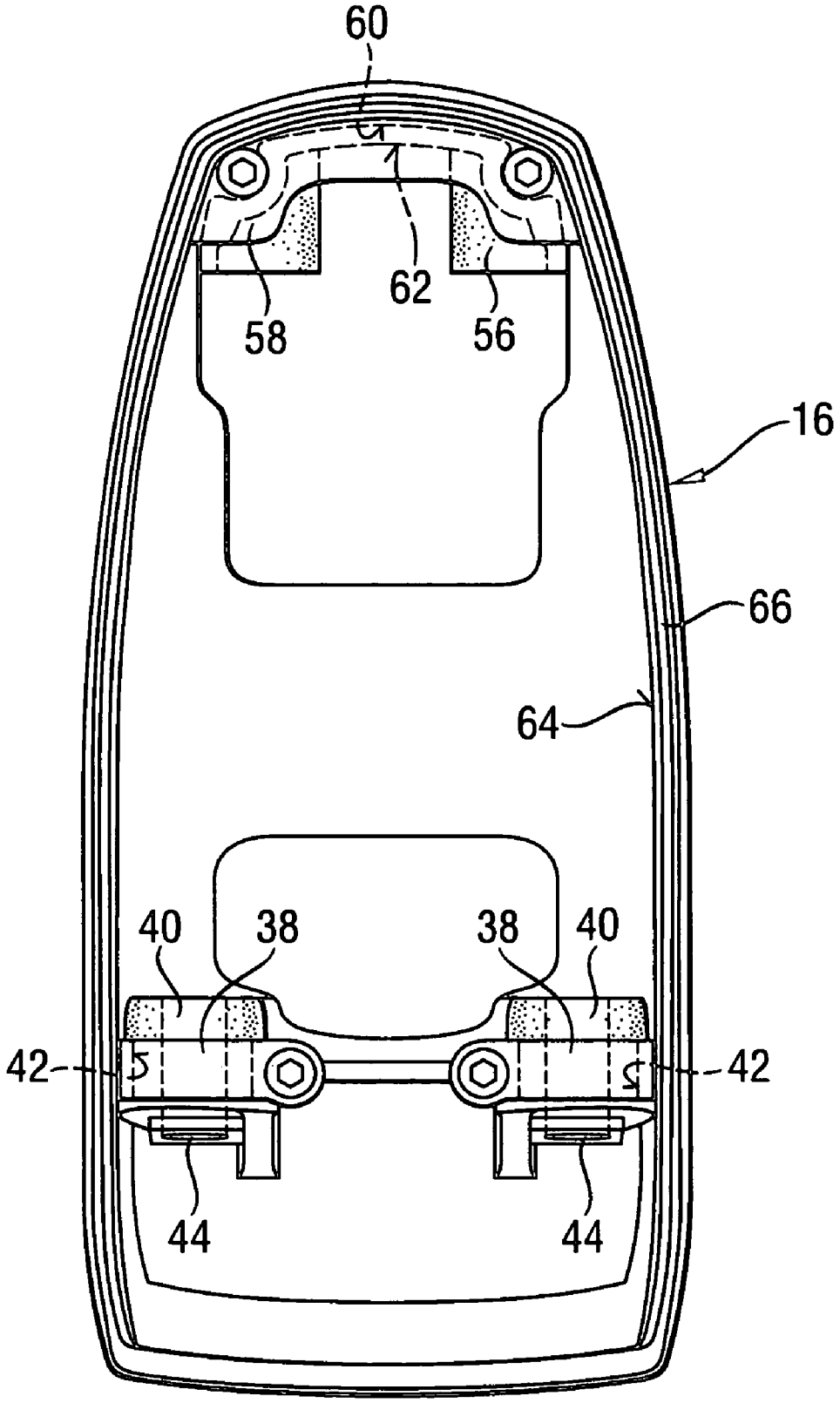
FIG. 4 a view of the handle housing of the power tool in direction IV in FIG. 1.

The connection device 28 further includes, on the main housing side, a plurality of openings 30 of a locking device likewise provided on the main housing side. The openings 30 are formed in four housing webs 36 which project from a rear side 34 of the main housing 4. As particularly shown in FIGS. 2-3, between each two respective housing webs 36, there is positioned an eyelet element 38 provided on the handle housing 16. The eyelet elements 38 are designed for receiving a second elastic element 40 likewise formed of a foamed plastics, and have, to this end, a through-opening 42 of the locking device provided on the handle side. The second elastic element 40 has a through-opening 44 that can be aligned with a respective adjacent, housing side opening 30.

The connection device 28 further includes two pin-shaped projections 46 which project from the motor cover 22. The openings 30, 42, the second elastic elements 40, and the projections 46 form, as it can be particularly seen in FIGS. 2-3, second connection means 48 of the connection device 28. The second connection means 48 are spaced from the first connection means 50 in the direction perpendicular to the operational axis 12.

Upon assembly of the power tool 2, the second elastic elements 40 are inserted in the openings 42 of the eyelet elements 38 which are provided on the handle housing 16. The first elastic element 56 is inserted in the receptacle 60 of engagement member 58, as shown in FIGS. 1-4.

Then, the handle housing 16 is mounted on the convex engagement member 52, with the engagement member 58 and the first elastic element 56 received therein being pinned onto the convex engagement member 52, as shown in FIG. 1 by mounting direction M1. The handle housing 16 is loosely mounted on the convex engagement member 52 because the engagement member 58 and the convex engagement member 52 are not directly mounted one upon the other in the direction perpendicular to the operational axis 12.

Thereafter, the lower end of the handle housing 16 remote from the operational axis 12 is pivoted about the first connection means 50 toward the main housing along the mounting direction M2, whereby the through-openings 44 in the second elastic elements 40, which are held in the handle-side openings 42 of the eyelet elements 38, become aligned with the openings 30 on the main housing side. For sealing the tool housing interior from outside, an elastic seal 66 is provided on a rim 64 along which the handle housing 16 adjoins the main housing 4 and/or the motor cover 22.

Figure 5:
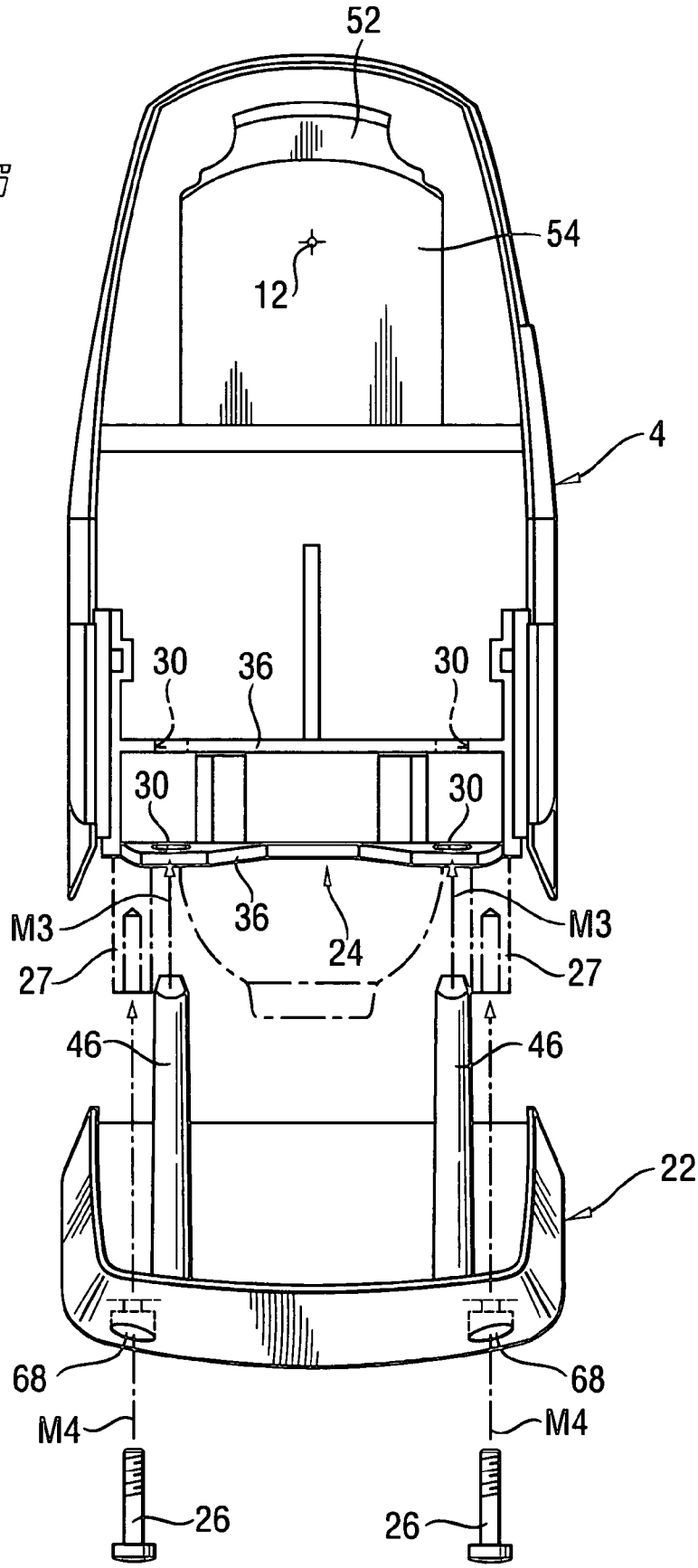
FIG. 5 a view of the main housing of the power tool in direction V in FIG. 1.

In a further mounting or assembly step, the motor cover 22 is displaced in a mounting direction M3 and closes the opening 24, as particularly shown in FIG. 5. At that, the projections 46 are pushed through the openings 42 in the second elastic elements 40, whereby the projections 46 formlockingly connect the handle side openings 42 with the main housing side openings 30, with respective second elastic elements 40 provided therebetween. With the screws 26 insertable through the screw opening 68 of the motor cover 22 in the mounting direction M4 and screwed into the extensions 27, the motor cover 22 is fixedly secured to the main housing 4, whereby the position of the motor cover 22 on the main housing 4 and, thereby, a formlocking connection of the handle housing 16 with the main housing 4 by the second connection means 48, is insured.

Simultaneously, with the formation of a formlocking connection of the handle housing 16 with main housing 4 by the second connection means 48, the engagement member 58 is so closely held on the engagement member 52 in the direction perpendicular to the operational axis 12, that it cannot pivot thereabout. Thus, with the formation of the formlocking connection between the handle housing 16 and the main housing 4 by the second connection means 48, and engagement of the handle housing 16 with the main housing 4 by the first connection means 50 in the direction perpendicular to the operational axis 12 is insured.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising:

a main housing (4);

a tool spindle (10) at least partially located in the housing (4), extending along an operational axis (12) and carrying a chuck (14);

a handle housing (16) on which a handle (18) is formed; and a connection device (28) for securing the handle housing (16) to a rear side (34) of the main housing (4) remote from the chuck (14), the connection device (28) having:

a first assembly (50) including:

a first engagement member (58) associated with the handle housing (16);

a first elastic element (56); and a second engagement member (52) associated with the main housing (4), wherein the second engagement member (52) has a convex shape directed towards an upper side of the power tool;

wherein the first engagement member (58) has a concave receptacle (60) for receiving the first elastic element (56); and wherein the first elastic element (56) has a convex receiving space (62) for receiving the convex shape of the second engagement member (58) such that the second engagement member (52) is loosely engaged with the first engagement member (58);

wherein the first assembly (50) of the first engagement member (58), the first elastic element (56), and the second engagement member (52) causes the main housing (4) to engage the handle housing (16) in a first engagement; and a second assembly (48) including:

an eyelet element (38) orientated along a vertical direction from the upper side to a lower side of the power tool, with the vertical direction being perpendicular to the operational axis (12);

two housing webs (36) separated along the vertical direction with each of the two housing webs (36) provided with through holes (30) being aligned along the vertical direction;

a second elastic member (40) having a through hole (44) and is received in the eyelet element (38) and also being received between the two housing webs (36) such that the through holes (30, 44) of the two housing webs (36) and of the second elastic element (40), respectively, are aligned; and a pin-shaped projection (46) which is inserted through the through holes (30, 44) for formlockingly connecting the the eyelet element (38) and the two housing webs (36), wherein the second assembly (48) of the eyelet element (38), the two housing webs (36), the second elastic member (40), and the pin-shaped projection (46) causes the main housing (4) to engage the handle housing (16) in a second engagement;

wherein upon formation of a formlocking connection of the eyelet element (38) with the two housing webs (36), simultaneously, absence of loose engagement in the first assembly (50) of the first engagement member (58), the first elastic element (56), and the second engagement member (52) is ensured; and wherein the first assembly (50) and the second assembly (48) are separated along the vertical direction, with the vertical direction being perpendicular to the operational axis (12).

2. A hand-held power tool according to claim 1, further comprising a third housing (22) which is securable to one of the main housing (4) and to the handle housing (16), wherein the pin-shaped projection (46) is fixed to the third housing (22).

3. A hand-held power tool according to claim 2, wherein the third housing (22) is a motor cover (22).

4. A hand-held power tool according to claim 3, wherein the motor cover (22) is screwed to the main housing (4) by a fastener (26).

* * * * *